United States Patent [19]

Field et al.

[11] 4,310,257

[45] Jan. 12, 1982

[54] TYPEWRITER CARTRIDGE LOCK-DOWN

[75] Inventors: Thomas R. Field; Mary L. VanArsdall, both of Lexington, Ky.

[73] Assignee: International Business Machines Corporation, Armonk, N.Y.

[21] Appl. No.: 103,818

[22] Filed: Dec. 14, 1979

[51] Int. Cl.[3] ..... B41J 32/00; B41J 35/28; B41J 35/22

[52] U.S. Cl. ..... 400/208; 292/241

[58] Field of Search ..... 400/207, 208; 292/217, 292/226, 240, 241

[56] References Cited

U.S. PATENT DOCUMENTS

| | | | |
|---|---|---|---|
| 2,759,749 | 8/1956 | Takats | 292/241 |
| 2,801,869 | 8/1957 | George | 292/226 |
| 2,829,341 | 4/1958 | Gietter | 292/240 |
| 2,831,718 | 4/1958 | Hallek et al. | 292/240 |
| 2,914,000 | 11/1959 | Mulcahy | 292/240 |
| 3,643,778 | 2/1972 | Anderson | 400/208 |
| 4,083,444 | 4/1978 | Salto | 400/208 |

OTHER PUBLICATIONS

Schaefer, "Two Color Cartridge . . . ", IBM Technical Disclosure Bulletin, vol. 22, No. 6, pp. 2327–2329, 11/79.

Treder, "Cartridge Latching", IBM Technical Disclosure Bulletin, vol. 21, No. 8, pp. 3323–3324, 1/79.

*Primary Examiner*—William Pieprz

*Attorney, Agent, or Firm*—William J. Dick

[57] ABSTRACT

In a typewriter, a ribbon is contained within a cartridge which is in turn placed upon the ribbon mechanism support of the typewriter. The cartridge is maintained rigidly clamped to the support but readily releasable by means of operator actuation of a release lever. The cartridge may either be a single cartridge or may be stacked such as where two cartridges are utilized together, one containing a print ribbon, the other containing, for example, a correction ribbon. The cartridge containing the print ribbon is provided with a bottom plate or surface which is formed to define an aperture therein for the admission of a clamping member attached to the support. The clamping member is inserted into the aperture and then caused to rotate about its axis a part turn at which point the clamping member engages an inclined surface on the interior of the cartridge causing the cartridge to be wedged downward against the support. In so wedging, the hold down mechanism is capable of retaining the cartridge in a fixed position to oscillate with the support.

1 Claim, 3 Drawing Figures

TYPEWRITER CARTRIDGE LOCK-DOWN

SUMMARY OF THE INVENTION AND STATE OF THE PRIOR ART

The present invention relates to ribbon cartridges, and more specifically relates to cartridge lock-down apparatus for a ribbon cartridge or cartridge assembly which is mounted to oscillate for placement of the ribbon held by the cartridges between the print element and character receiving medium at various levels so as to achieve maximum use of the ribbon.

Correction typewriter and mechanisms for feeding print ribbons and correction ribbons on typewriters have become relatively well known. A prime example of a typewriter employing both a print ribbon and a correction ribbon is the IBM Correcting SELECTRIC typewriter which embodies ribbon feed mechanism and a ribbon cartridge substantially similar to that disclosed in U.S. Pat. No. 3,604,549 and U.S. Pat. No. 3,731,781. The correction tape feed is similar to that disclosed in U.S. Pat. No. 3,724,633.

With the increase in the use of cartridges employing a print ribbon or a correction ribbon, due to their ease of insertion and threading of the ribbon and the cleanliness associated with handling thereof, it has become desirable to implement a system whereby the printing ribbon and the correction ribbon are both contained within cartridges. An example of a ribbon feed and cartridge assembly design for accomplishing this is disclosed in the co-pending patent application of John O. Schaefer, Ser. No. 801,286, filed May 27, 1977 and commonly assigned with this application.

The present invention teaches a typewriter cartridge lock-down with a cartridge of a type designed to oscillate to expose different portions of a print or connection ribbon held by the cartridge intermediate the element of a single element typewriter and the platen. In this correction, the cartridge is specifically designed to be employed in the structure illustrated in patent application, Ser. No. 853,704, filed on Nov. 21, 1977 by John O. Schaefer, now abandoned and the continuation thereof filed on Oct. 3, 1979, Ser. No. 81,586, both applications being herein incorporated by reference.

In view of the above, it is a principle object of the present invention to provide a cartridge either singularly or in pairs which is of simple construction and yet is easily lockable to the oscillating support of a typewriter of the type having ribbon drive and feed mechanism as above identified in the co-pending and incorporated by reference patent applications of Schaefer.

Another object of the present invention is to provide a cartridge lock-down scheme which is easily manipulated by the operator for rapid loading and unloading of the cartridge or cartridge pair in a typewriter.

Other objects and a more complete understanding of the invention may be had by referring to the following specification and claims taken in conjunction with the accompanying drawings.

DRAWING DESCRIPTION

Figure 1:
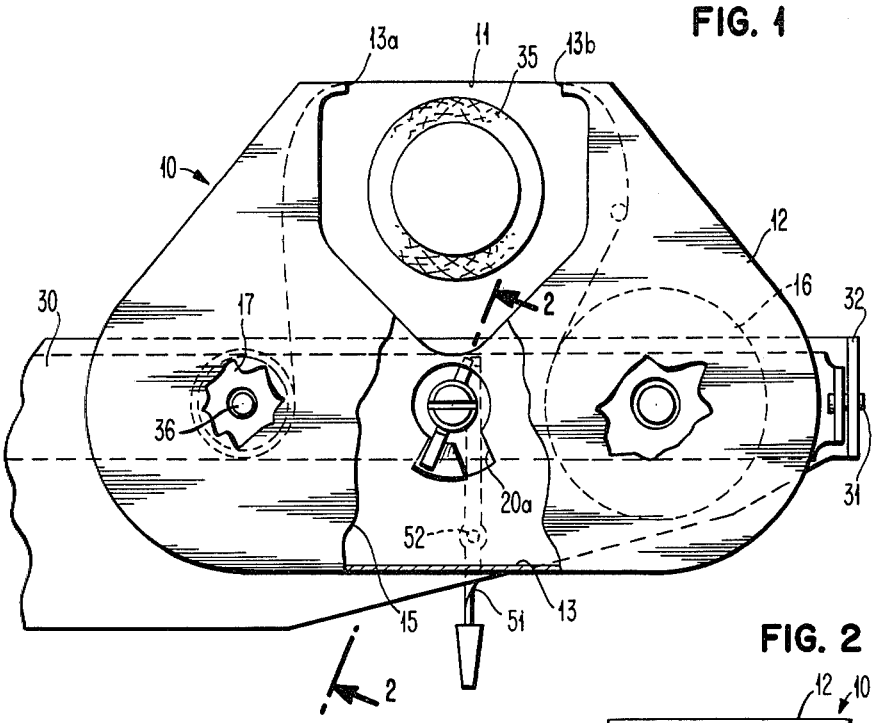
FIG. 1 is a fragmentary sectional view in plan of a cartridge mounted on an oscillating support and locked in position by a clamp cooperating with the cartridge, which cartridge has been constructed in accordance with the present invention.

Referring now to the drawings, and especially FIG. 1 thereof, a cartridge 10, in the present instance a pair of cartridges 10 and **10*a* (see FIG. 2) are mounted in superimposed overlapping relation on a support 30 which is pivotally connected as by a pivot pin 31 to a frame portion 32 of a typewriter or the like. The support 30 is adapted to oscillate the cartridge 10 or cartridge pair 10 and 10*a* into and out of the plane of the drawing to present different portion of a ribbon 11 (print ribbon) or correction ribbon (not shown) carried by the cartridge 10*a* to a printing element 35 shown in dotted lines in FIG. 1. The printing element 35 may be the typical ball such as found in the IBM SELECTRIC typewriter, or may be of other single element design such as a daisy like print wheel. The cartridge 10 includes a top wall 12, and spaced apart bottom wall 14 with a discontinuous side wall 13 which joins the top and bottom walls 12 and 14 respectively adjacent their peripheries to form a chamber 15, the side walls being discontinuous at predetermined locations such as at 13*a*, 13*b* to allow for entrance and exit respectively of ribbon housed within the chamber 15. As illustrated, the chamber 15 holds a supply of print ribbon 11 as on a supply spool 16, the ribbon progressing through the exit 13*b* to the entrance 13*a* for takeup on a takeup spool 17. As illustrated in the co-pending patent application of John O. Schaefer, filed on Oct. 3, 1979, Ser. No. 81,586, which is a continuation of Ser. No. 853,704, filed on Nov. 21, 1977, now abandoned, and which applications are herein incorporated by reference, ribbon drive mechanism engages into the side walls of the cartridges 10 and 10*a* to engage the takeup spool 17 associated with the cartridge 10 and the associated takeup spool (not shown) of the correction ribbon housed in the cartridge 10*a* for selective driving of the ribbons from their associated supply spools to their takeup spools. Additional mechanism is illustrated in the aforementioned co-pending patent application for effecting oscillation of the support 30**.

In order to provide uniformity of typing due to the treatment and relative rough handling of the cartridge 10 and cartridge **10*a* during oscillation of the support 30 and the rapid beating of the single element 35 against the ribbon 11, it is mandatory that the cartridge or cartridge pair be firmly but easily removably fixed to the support 30. In accordance with the invention, means are provided within the cartridge 10 for clamping at least the upper most cartridge 10 to the support 30, in the illustrated instance including the cartridge 10*a*, so as to inhibit relative movement of the cartridge 10 and 10*a* relative to the support during operation of the typewriter. To this end, and in accordance with the invention, the bottom wall 14 of the cartridge 10 is provided with means defining an opening 20 therein dimensioned for admission of clamping means 40 therethrough for pressing engagement with the bottom wall 14 of the cartridge 10 to force the cartridge 10 downwardly towards the support 30**.

In order to accomplish this clamping, the clamping means 40 comprises an upstanding member 41 which is mounted for rotation as through a leg like offset portion 42 to the support 30 as by a pivot pin 43. The support 30 is suitably slotted as at 33 to provide an opening for the upstanding member 41 and permit rotation thereof for purposes which will become more clear hereinafter. Projecting from said upstanding member 41 is a surface engaging tab 44 which cooperates with a ramp 21 having an inclined surface 21*a* on the bottom wall 14 of the cartridge 10 and adjacent to the opening 20. As shown, the inclined surface 21*a* inclines upwardly into the chamber 15 from the entry portion 20*a* of the opening 20 which permits entry of the tab 44 into the chamber 15 for engagement with the inclined surface 21*a*.

In the illustrated instance, the opening 20 is also dimensioned to receive an upstanding post or alignment guide 36, in the present instance including the pivot stud 43 which passes through an aperture 42*a* in the leg 42 of the clamping means 40.

In order to urge the tab 44 into engagement with the inclined surface 21*a* of the ramp 21 on the bottom wall 14 of the cartridge 10, it is preferable that biasing means, in the present instance a spring 50 be interconnected between the support 30 and a tang 45 which depends from the clamping means 40 adjacent the aperture 42*a*, which tends to urge the tab 44 upwardly along the inclined surface 21*a* effecting a wedging action tending to force the cartridge 10 downwardly towards the support 30.

In order to effect easy mounting and removal of the cartridge or cartridge assembly including the upper cartridge 10 and lower cartridge 10*a*, selectively operable means engageable by the operator are provided. For example, and as best shown in FIGS. 2 and 3, a lever 51 which is pivoted as at 52 to the support 30, engages a depending leg portion 46 of the clamping means 40, so that upon operator movement of the lever 51 in the direction of the arrow 55, the upstanding member 41 will tend to rotate towards the opening 20*a* permitting ease of lifting the cartridge 10 as well as the cartridge 10*a* from the support 30, by aligning the tab 44 with the opening 20*a*.

Moreover, it should be recognized that the lever 51 may also be connected to the hand operated lever associated with the ribbon drive means which effects manual disengagement of the drive means from the takeup spools associated with the cartridges 10 and 10*a*. This interconnection may be easily made by one skilled in the art to the apparatus illustrated in the aforementioned incorporated by reference patent applications of John O. Schaefer. However, if it is desired, a separate lever 51 such as illustrated above and shown in the drawings may be employed.

While the guide or post 36 serves the function of front to back positioning for the cartridge 10 or 10*a* on the support 30, in order to inhibit rotation of the cartridges it may be helpful to include additional supports 36 and 37 projecting upwardly from the support 30 to register with openings in the cartridge 10*a* thereby inhibiting any tendency of the cartridges to rotate relative to the support 30.

Figure 2:
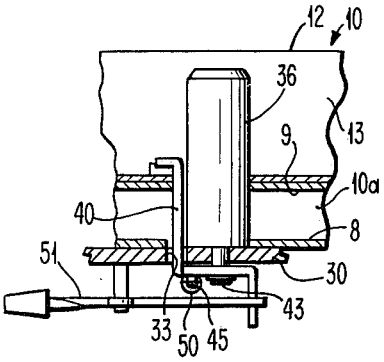
FIG. 2 is a fragmentary sectional view taken along line 2—2 of FIG. 1.
Figure 3:
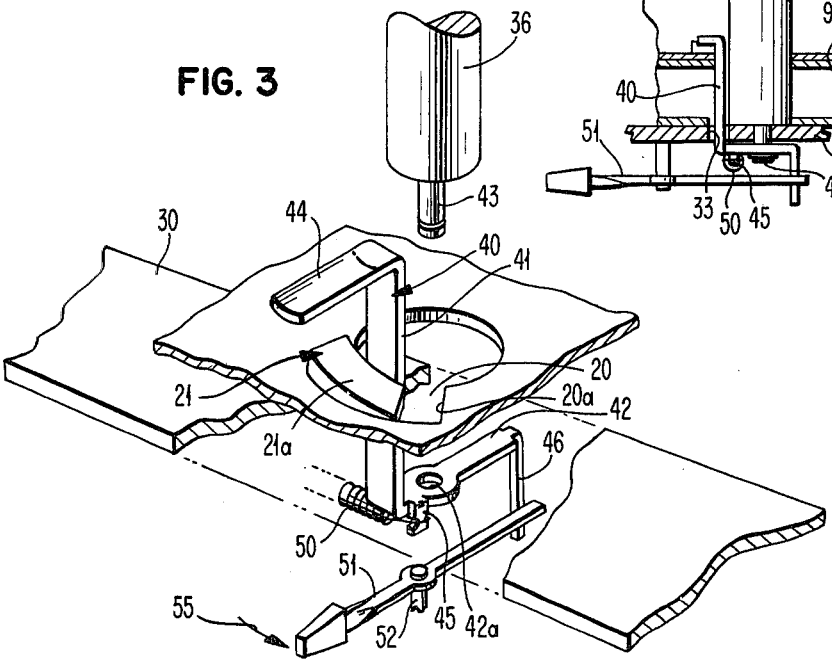
FIG. 3 is a fragmentary exploded perspective view of the cartridge and lock-down mechanism operative in accordance with the present invention.

With the cartridges 10 and 10*a* in superimposed overlapping relation as illustrated in FIG. 2, it is also necessary that a like aperture or opening is provided in both the bottom and top wall 8 and 9 respectively of the cartridge 10*a* to permit passage therethrough of the post or guide 36 as well as the clamping means 40. Moreover, in the event that it is desired not to employ a second cartridge loaded with correction ribbon beneath the cartridge 10 a second ribbon cartridge of other color may also be employed, or a dummy cartridge so that the necessary spacing between the bottom wall 14 of the cartridge 10 and the support 30 may be maintained to effect a pressing wedge like engagement between the tab 44 of the clamping means 40 and the inclined surface 21*a* associated with the bottom wall of the cartridge 10. Moreover, if desired, a single cartridge may be employed with necessary adjustments in the length of the upstanding member 41 and guide post 36 to enable pressing engagement of the tab 44 against the inclined surface 21*a* of the cartridge 10.

Thus the present invention provides a quick, economical and easy means for coupling and uncoupling a novel cartridge to a typewriter.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed.

What is claimed is:

1. A ribbon cartridge assembly for retaining and supporting a ribbon in a typewriter, said typewriter including a support for said cartridge assembly and an upstanding, centrally positioned post projecting from said support; an upstanding member mounted for rotation on said support, adjacent said post, and including a tab projecting from said member substantially perpendicularly thereto; said cartridge assembly comprising:

a first ribbon cartridge superimposed on a second cartridge, each of said cartridges comprising spaced apart top and bottom walls and a side wall joining said top and bottom walls adjacent the periphery thereof to form separate chambers, said side walls of each cartridge being discontinuous at predetermined locations to form at least entrance and exit apertures for separate ribbons; said bottom wall of said first ribbon cartridge and the top and bottom wall of said second ribbon cartridge including aligned openings dimensioned for admitting therethrough said post, member and tab; said bottom wall of said first cartridge including a ramp adjacent to its said opening in its said chamber, said ramp having an inclined surface engageable by said tab; biasing means connected to said member for rotating said member and urging said tab into engagement with and upwardly of said inclined surface, to thereby force said first cartridge downwardly against said second cartridge and thereby lock said cartridge assembly against said support; and means connected to said member for effecting disengagement of said tab from said ramp against the urging of said biasing means.

* * * * *